US008910403B2

(12) United States Patent
Nimtz

(10) Patent No.: US 8,910,403 B2
(45) Date of Patent: Dec. 16, 2014

(54) GLOWING FRAME FOR A HAZARDOUS WARNING PLACARD

(71) Applicant: Pat D. Nimtz, Onalaska, WI (US)

(72) Inventor: Pat D. Nimtz, Onalaska, WI (US)

( * ) Notice: Subject to any disclaimer, the term of this patent is extended or adjusted under 35 U.S.C. 154(b) by 0 days.

(21) Appl. No.: 13/898,138

(22) Filed: May 20, 2013

(65) Prior Publication Data

US 2013/0318843 A1 Dec. 5, 2013

Related U.S. Application Data

(60) Provisional application No. 61/652,790, filed on May 29, 2012.

(51) Int. Cl.

| | |
|---|---|
| ***G09F 21/04*** | (2006.01) |
| ***G09F 13/00*** | (2006.01) |
| *G09F 13/22* | (2006.01) |

(52) U.S. Cl.

CPC ..... *G09F 13/00* (2013.01); *G09F 21/04* (2013.01); *G09F 2013/222* (2013.01)

USPC ..... 40/590; 40/544; 40/588

(58) Field of Classification Search

USPC ..... 40/544, 546, 570, 588, 590, 591, 714

See application file for complete search history.

(56) References Cited

U.S. PATENT DOCUMENTS

| | | | | |
|---|---|---|---|---|
| 4,096,656 | A * | 6/1978 | Diceglie | 40/564 |
| 4,229,891 | A * | 10/1980 | Keller | 40/653 |
| 4,715,138 | A * | 12/1987 | Cherico | 40/591 |
| 7,707,759 | B2 * | 5/2010 | Roberts | 40/611.11 |

* cited by examiner

*Primary Examiner* — Joanne Silbermann

(57) ABSTRACT

A glowing frame for a hazardous material placard is an apparatus used to illuminate the hazardous material placard during the night or dangerous weather conditions. The apparatus is attached to a vehicle carrying hazardous material and includes a frame, a plurality of light emitting diode (LED) strips, a drain hole, a pair of wires, and a disconnection mechanism. The hazardous material placard and the LED strips are situated in between a front portion and a back portion of the frame. The drain hole allows moisture to be released from within the frame. The pair of wires is used to complete a circuit between the LED strips and the vehicle's side-marker or tail light system. The disconnection mechanism activates the LED strips and locks the placard in place. In addition, the disconnection mechanism deactivates the LED strips and releases the placard from the frame.

12 Claims, 9 Drawing Sheets

GLOWING FRAME FOR A HAZARDOUS WARNING PLACARD

The current application claims a priority to the U.S. Provisional Patent application Ser. No. 61/652,790 filed on May 29, 2012.

FIELD OF THE INVENTION

The present invention generally relates to an apparatus for semi-tractor trailer trucks that carry hazardous material. More specifically, the present invention illuminates a placard, which allows other automobiles on a road to be aware of the hazardous material being carried by the equipment, especially at night or in dangerous weather conditions.

BACKGROUND OF THE INVENTION

The general population does not really pay close attention to hazardous material placards on commercial carriers. Thus, the present invention is used to bring attention to hazardous material placards and improves the overall safety for commercial carriers. The present invention is directly connected to the marker lights of a commercial carrier. Many drivers with a commercial driver license (CDL) do not pay attention to what is on the side of a tractor trailer. In addition, once the sun goes down, seeing a 10.7 inch cardboard placard becomes even more difficult.

An objective of the present invention is to provide a glowing frame that makes placards more noticeable, especially at night. The present invention would also make such placard more noticeable in poor weather such as heavy rain, snow, or fog. Subsequently, the awareness of such placards would greatly improve for other motorists sharing the road. CDL drivers would no longer get to their destination to find that one or more of their placards have fallen of the trailer because the present invention securely attaches placards to the trailer. CDL drivers can eliminate a lot of headache with the present invention.

The present invention should provide everyone with better awareness to equipment carrying hazardous materials and provide the transportation officials with an even easier way to identify this equipment at night. The present invention is also designed to provide emergency response teams with a glowing placard in order to create faster awareness to a potentially dangerous situation. The overall goal is to see every semi-trailer, rail container, and fuel truck with the present invention in order to ensure that every driver on the road can see the potential danger of the product each vehicle is carrying.

The history of the placard industry has been simple aluminum holders, polycarbonate holders, and plastic holders. To this date, there is nothing available in the marketplace as far as a glowing placard holder. With the present invention, there should be very strong growth in this category over the next several years as well as a strong possibility that federal transportation officials mandate the present invention be installed on all new equipment.

DETAILED DESCRIPTIONS OF THE INVENTION

All illustrations of the drawings are for the purpose of describing selected versions of the present invention and are not intended to limit the scope of the present invention.

Figure 1:
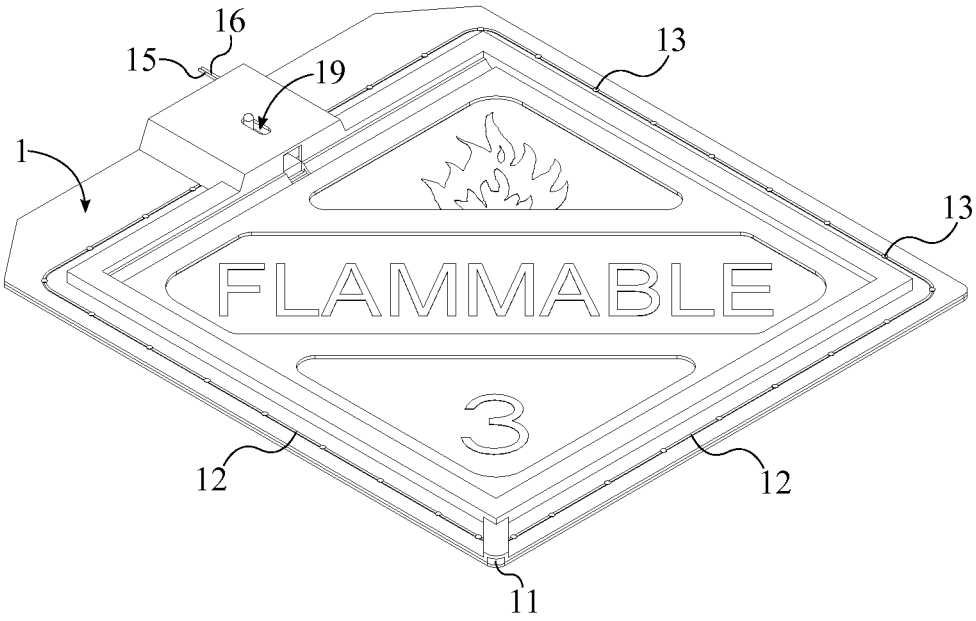
FIG. 1 is a perspective view of the present invention with a hazardous material placard.

As can be seen in FIG. 1, the present invention is a glowing frame for a hazardous material placard and is used to illuminate and highlight the hazardous material placard on a vehicle. The present invention is typically attached to the trailer of the vehicle. The glowing frame allows other vehicles to see the hazardous material placard during the night or during weather conditions that reduce visibility. The glowing frame also allows emergency responders will be able to see the hazardous material placard in case the vehicle is in an accident. The present invention mainly comprises a placard frame 1, a drain hole 11, a plurality of weatherproof light emitting diode (LED) strips 14, a first wire 15, a second wire 16, and a disconnection mechanism 19. The plurality of weatherproof LED strips 14 is located around the hazardous material placard in order to evenly illuminate the viewing area of the hazardous material placard. The placard frame 1 is used to support the hazardous material placard onto the vehicle and is used as a base to properly situate the other components of the present invention. The plurality of weatherproof LED strips 14 and the placard frame 1 are designed with materials to withstand continuous exposure to outdoor conditions. Moisture that collects within the placard frame 1 can be release through the drain hole 11. The first wire 15 and the second wire 16 are used to electrically splice into the vehicle's side-marker-light or tail-light circuit system. The disconnection mechanism 19 is used to lock the hazardous material placard within the placard frame 1 and to turn on the plurality of weatherproof LED strips 14. Conversely, the disconnection mechanism 19 is also used to unlock the hazardous material placard from the placard frame 1 and to turn off the plurality of weatherproof LED strips 14.

Figure 2:
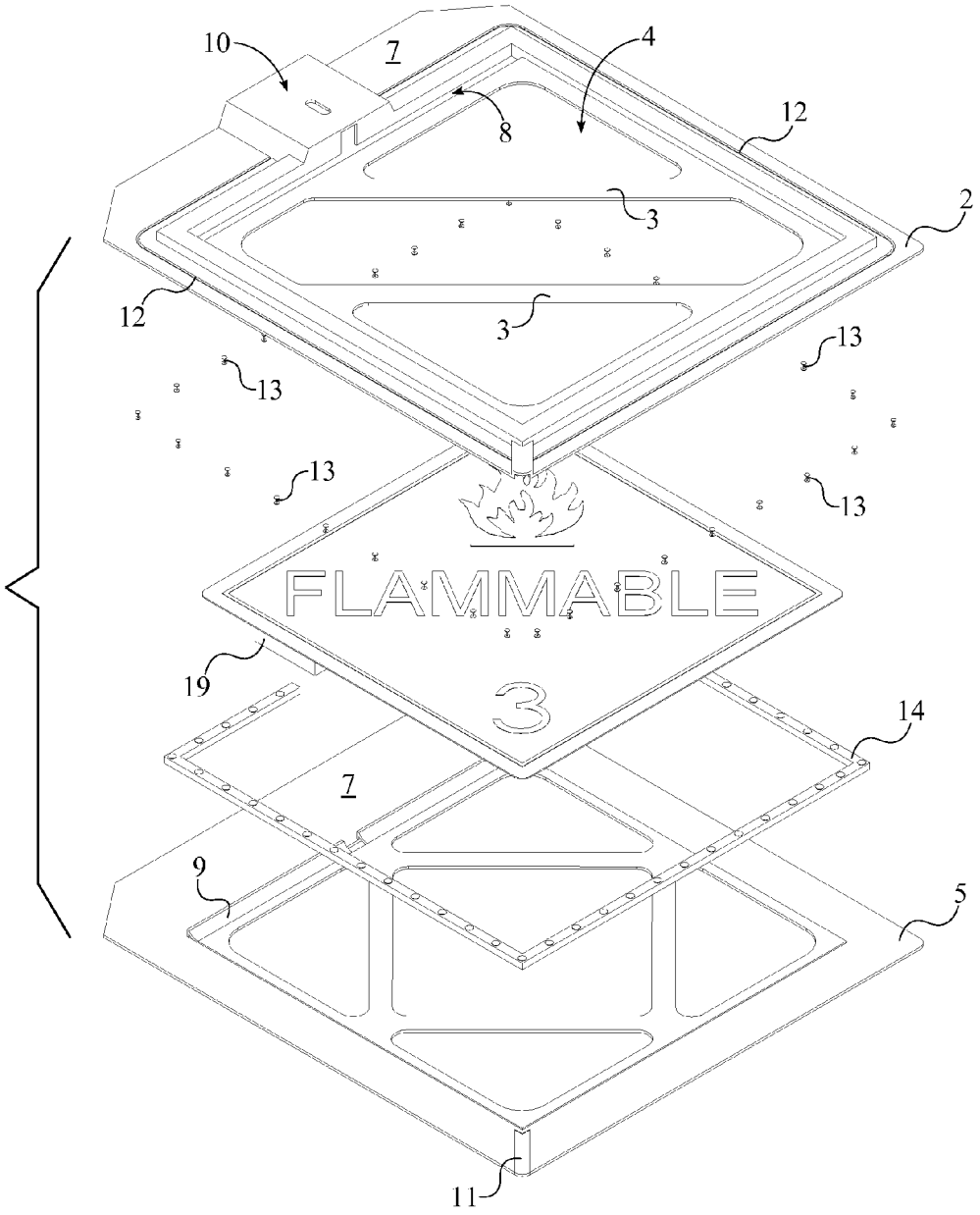
FIG. 2 is an exploded perspective view of the present invention with the hazardous material placard.
Figure 3:
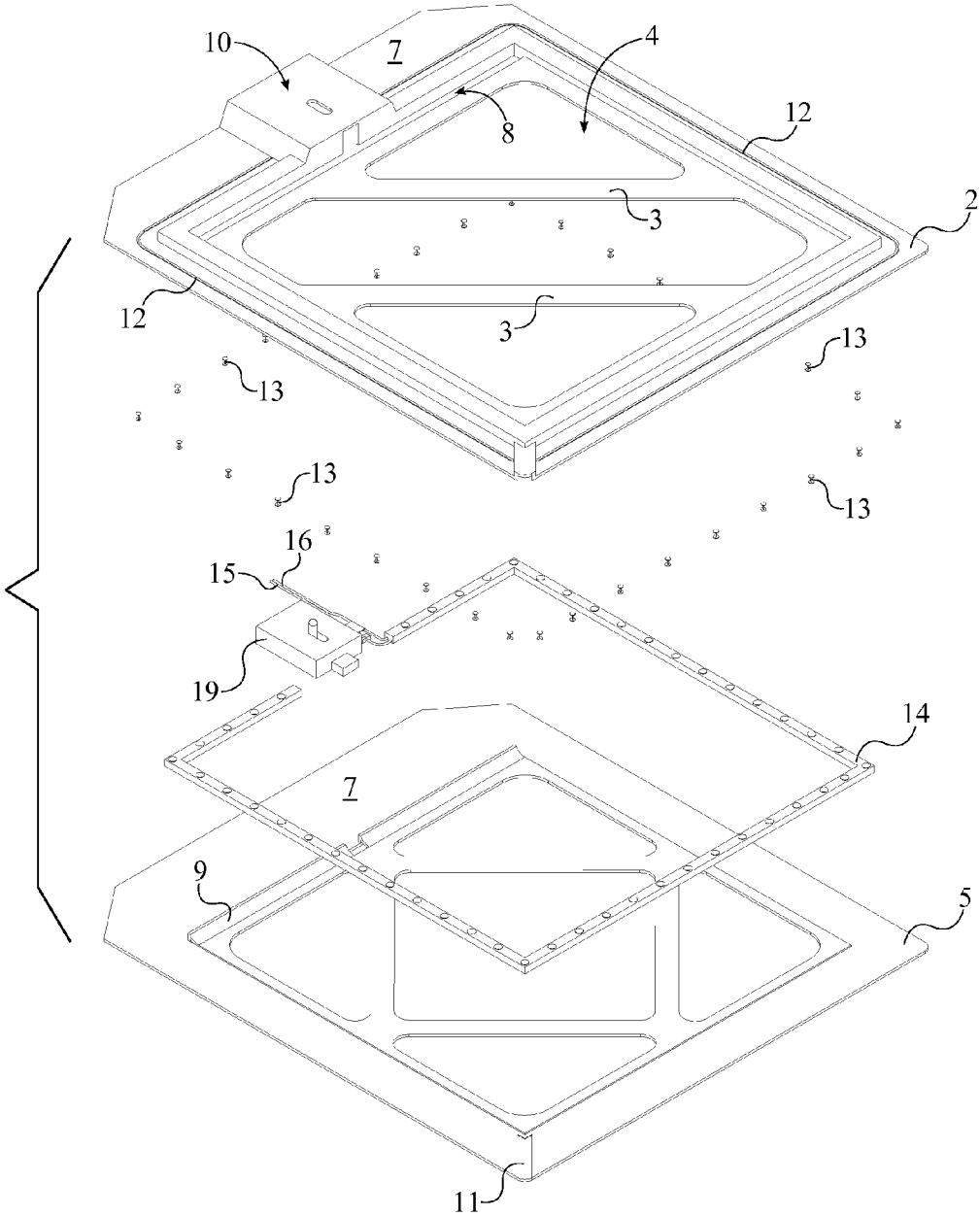
FIG. 3 is an exploded perspective view of the present invention without the hazardous material placard.
Figure 4:
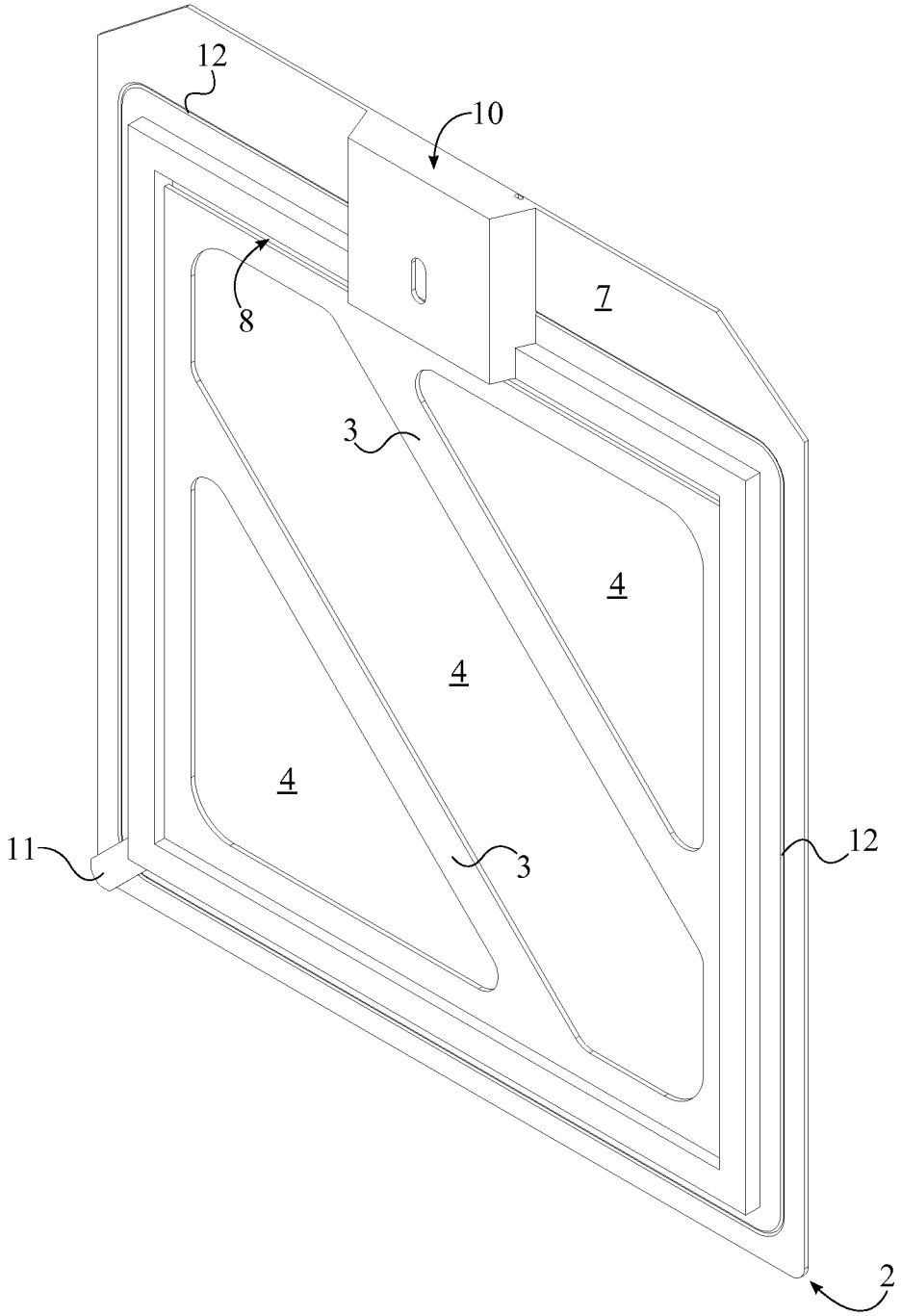
FIG. 4 is a perspective view of the front portion of the placard frame.
Figure 8:
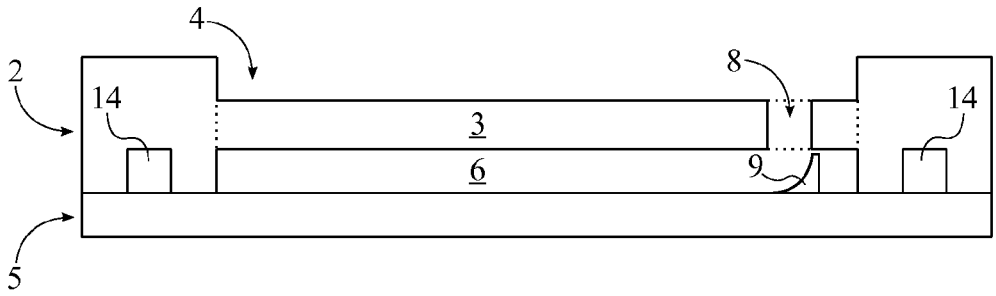
FIG. 8 is a schematic cross-section view of the present invention.

The placard frame 1 allows the hazardous material placard to be easily inserted and removed from the present invention. The configuration of the hazardous material placard within the placard frame 1 is illustrated in FIGS. 2 and 3. In the preferred embodiment of the present invention, the placard frame 1 is made of a high quality polycarbonate, which should allow a 7 year life expectancy for the present invention. The placard frame 1 comprises a front portion 2, a back portion 5, a housing cavity 6, a wing extension 7, a placard slot 8, a ramp 9, and a mechanism compartment 10. The front portion 2 is concentrically positioned onto the back portion 5 because the front portion 2 and the back portion 5 are the structural pieces of the placard frame 1. The front portion 2 is configured differently than the back portion 5 because the viewing area of the hazardous material placard must be visible through the placard frame 1. Thus, the front portion 2 comprises a plurality of grids 3 and a placard window 4, which are shown in FIG. 4. The placard window 4 is a cutout section of the front portion 2, which allows the hazardous material placard to be seen through the front portion 2. In addition, the placard window 4 centrally traverses through the front portion 2. In the preferred embodiment of the present invention, the placard window 4 is designed to match the size of a typical hazardous material placard, which is usually 10.8 inches by 10.8 inches. The plurality of grids 3 is used to brace the hazardous material placard against the back portion 5. The plurality of grids 3 is positioned across the placard window 4 so that the hazardous material placard does not fall out through the placard window 4. In the preferred embodiment, the plurality of grids 3 is specifically configured not to obstruct the lettering and symbols on a typical hazardous material placard. As can be seen in FIG. 8, the housing cavity 6 is the allotted space to hold the hazardous material placard within the placard frame 1. The housing cavity 6 is positioned in between the plurality of grids 3 and the back portion 5 and is laterally delineated by the placard window 4. The drain hole 11 is used to release any moisture that has collected within the housing cavity 6. Thus, the drain hole 11 traverses out of the housing cavity 6 and through both the front portion 2 and the back portion 5 so that the moisture can exit through the bottom of the placard frame 1.

Figure 5:
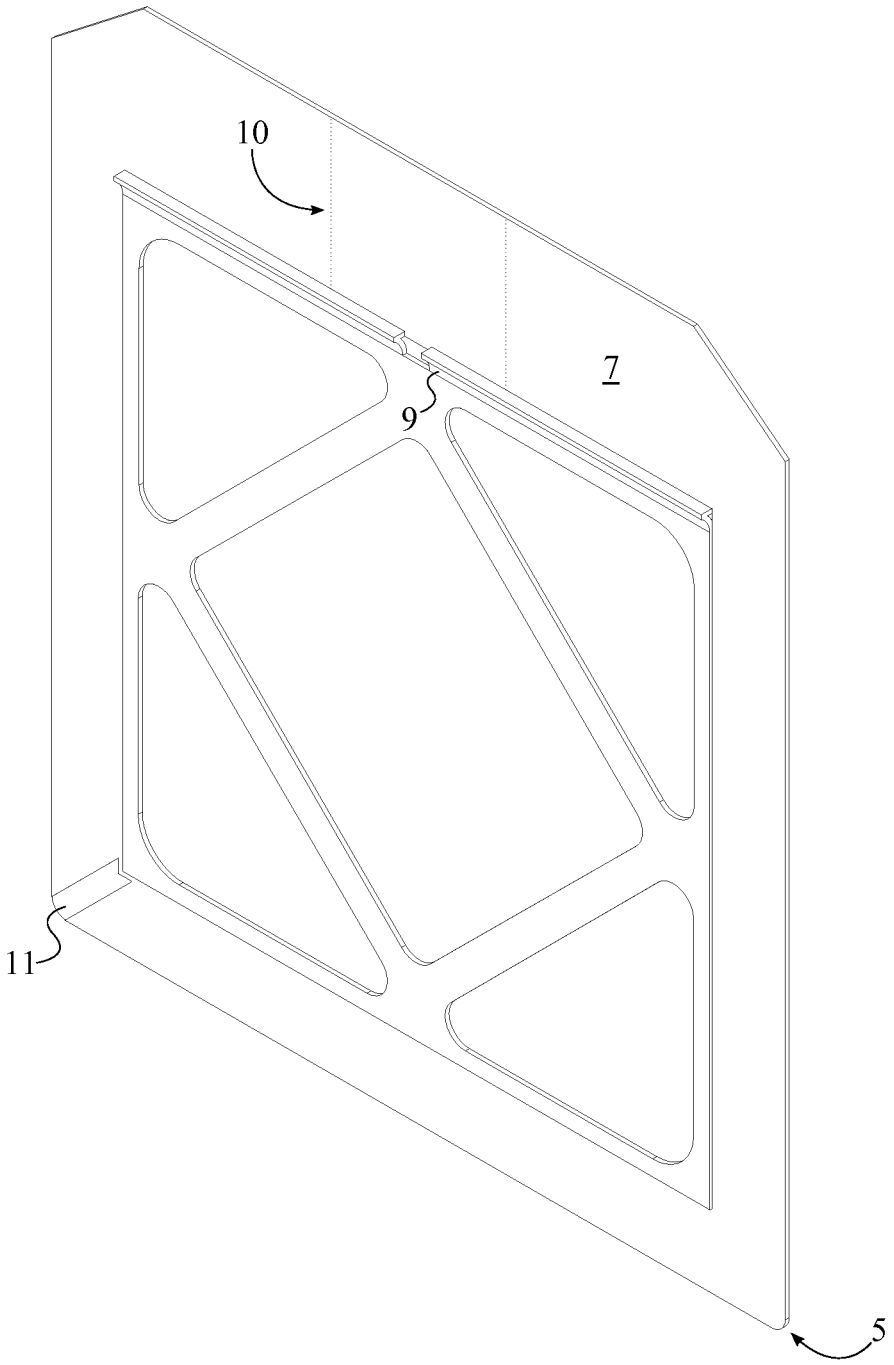
FIG. 5 is a perspective view of the back portion of the placard frame.

In reference to FIGS. 4 and 5, the wing extension 7 is a structural piece of the placard frame 1 and is connected adjacent to both the front portion 2 and the back portion 5. The mechanism compartment 10 is centrally integrated into the wing extension 7 so that the disconnection mechanism 19 can be situated on the placard frame 1. The placard slot 8 is used as the doorway into the housing cavity 6, and, thus, the placard slot 8 traverses through the front portion 2 and into the housing cavity 6. The placard slot 8 is positioned adjacent to the mechanism compartment 10, which allows the disconnection mechanism 19 to physically lock the hazardous material placard within the housing cavity 6. The ramp 9 is used to ease the transition of the hazardous material placard into the housing cavity 6. Consequently, the ramp 9 is positioned along placard slot 8 and is connected to the back portion 5 so that the hazardous material placard immediately engages the ramp 9 as the placard slides through the placard slot 8 and into the housing cavity 6.

Figure 6A:
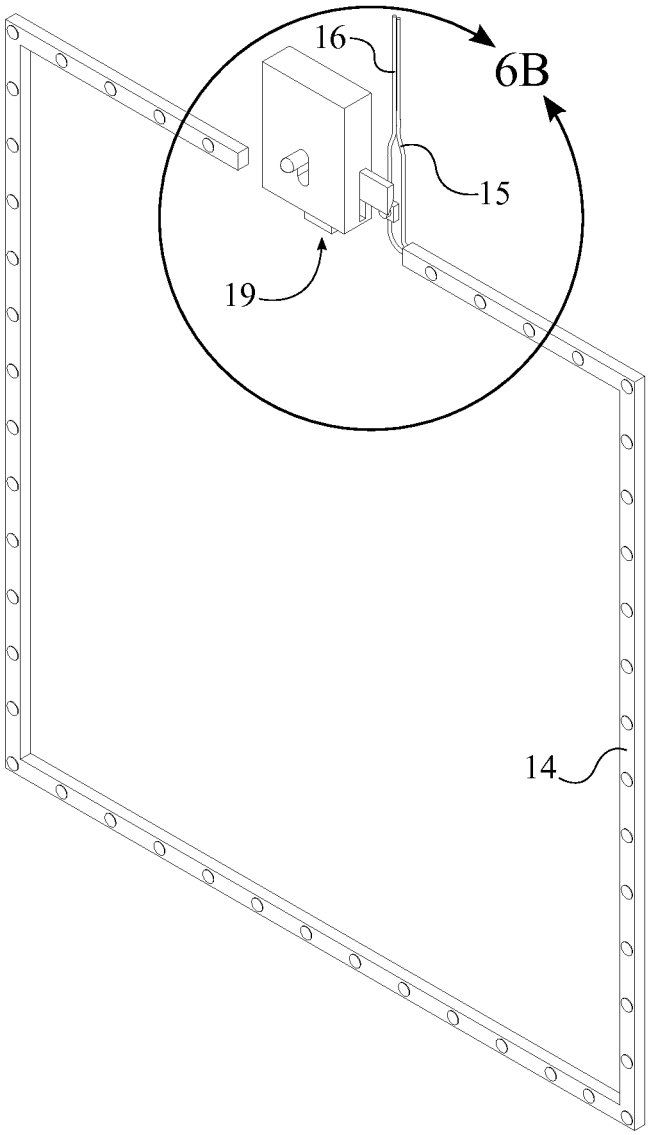
FIG. 6A is a perspective view of the present invention without the placard frame, while the disconnection mechanism is in the unlocked position.
Figure 7:
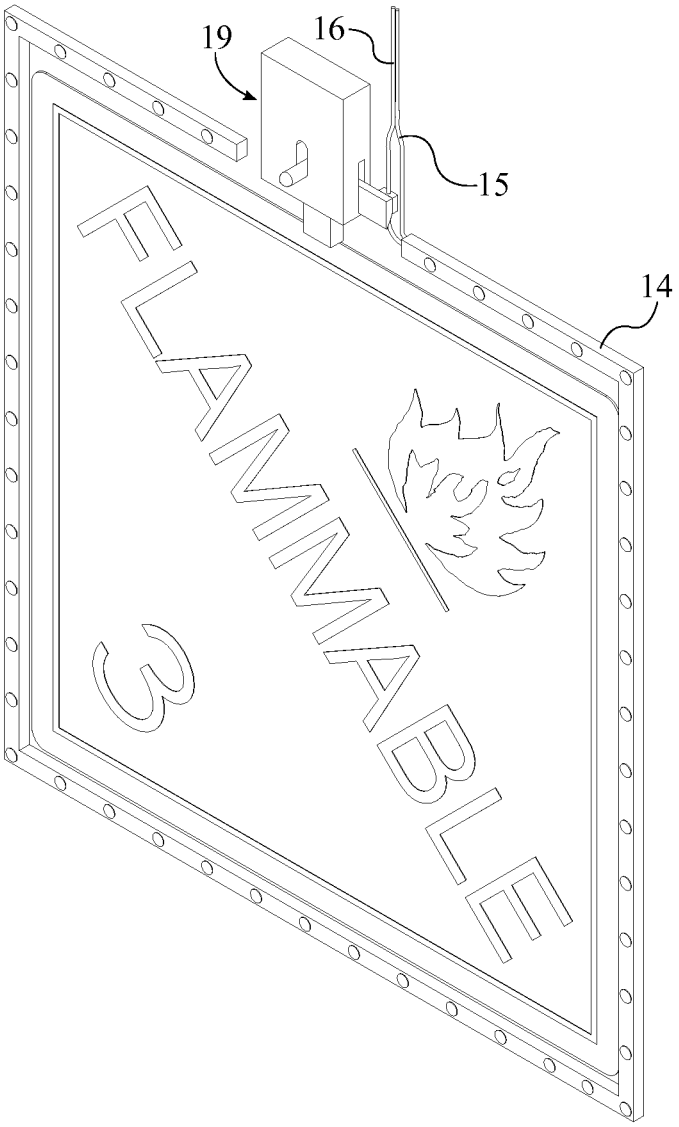
FIG. 7 is a perspective view of the present invention without the placard frame, while the disconnection mechanism is in the locked position holding the hazardous material placard in place.

As can be seen in FIGS. 6A and 7, the plurality of weatherproof LED strips 14 is used as a low cost, low power means of illuminating the hazardous material placard. The plurality of weatherproof LED strips 14 must reliable in different kinds of weather and climate conditions. In order to illuminate the hazardous material placard evenly, the plurality of weatherproof LED strips 14 is conformingly positioned around the placard window 4. The plurality of weatherproof LED strips 14 should also be located around the placard slot 8 so that the plurality of weatherproof LED strips 14 does not intersect with the housing cavity 6. In addition, the plurality of weatherproof LED strips 14 is housed in between the front portion 2 and the back portion 5, which situates the plurality of weatherproof LED strips 14 in the proper position around the placard window 4. Typically, the plurality of weatherproof LED strips 14 needs to be illuminated an amber color if the present invention is mounted on the side of the vehicle and needs to be illuminated a red color if the present invention is mounted on the back of the vehicle.

Figure 6B:
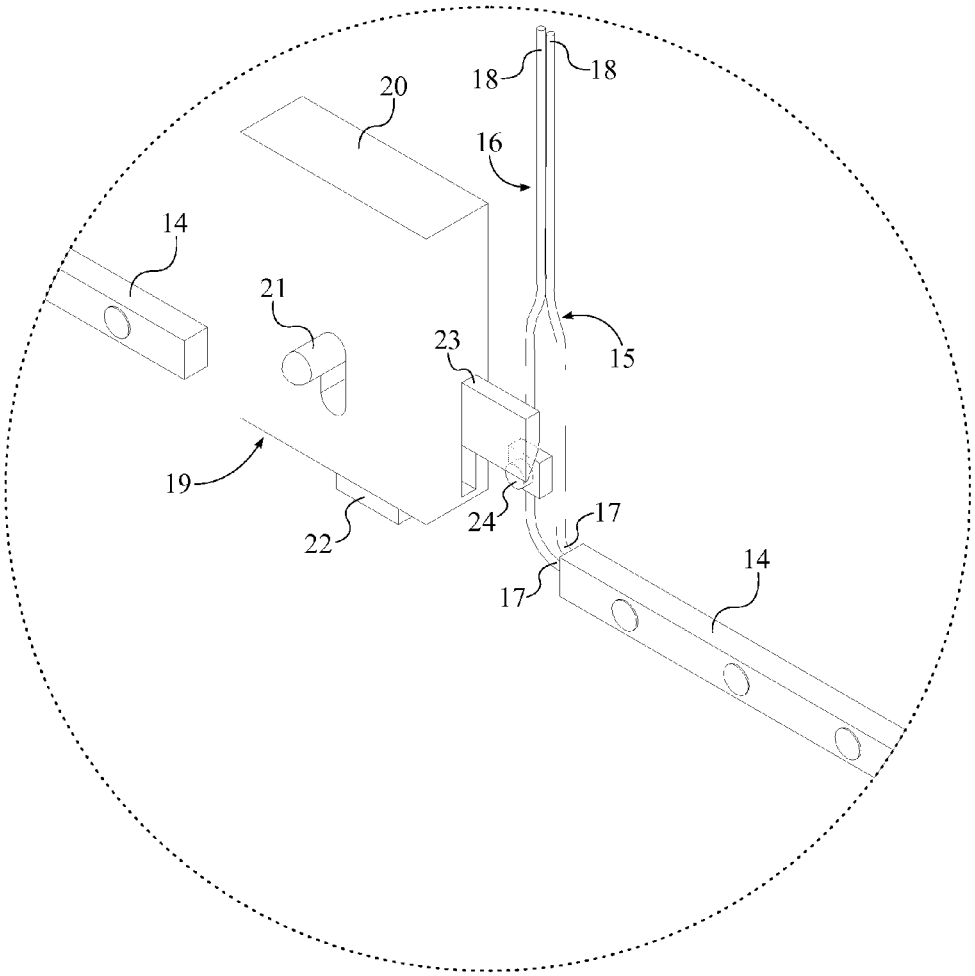
FIG. 6B is a magnified view of the disconnection mechanism for the present invention and is referenced by FIG. 6A.

The disconnection mechanism 19 allows the present invention to lock a placard within the housing cavity 6, to activate the plurality of weatherproof LED strips 14 while the placard is within the housing cavity 6, and to deactivate the plurality of weatherproof LED strips 14 when the placard is removed from the housing cavity 6. The disconnection mechanism 19 comprises a guide body 20, a trigger 21, a locking bar 22, and inclined protrusion 23, which are shown in FIG. 6B. The locking bar 22 is used to close off the placard slot 8 once the hazardous material placard is slid into the housing cavity 6, which prevents the hazardous material placard from falling out of the housing cavity 6. Thus, the locking bar 22 is positioned perpendicular to the placard slot 8, which allows the locking bar 22 to slide into the placard slot 8 in order to lock the hazardous material placard within the housing cavity 6 and allows the locking bar 22 to slide out of the placard slot 8 in order to release the hazardous material placard from the housing cavity 6. The guide body 20 is mounted within the mechanism compartment 10 and is used as a base in order to control the motion of the locking bar 22 into and out of the placard slot 8. In order to control the motion of the locking bar 22, the locking bar 22 needs to be able to traverse through the mechanism compartment 10 and needs to be slidably engaged to the guide body 20. The trigger 21 allows the user to direct the movement of the locking bar 22 into and out of the placard slot 8. The trigger 21 traverses through the mechanism compartment 10 and is connected to the locking bar 22 so that the user can press against the trigger 21 in order to move the locking bar 22. The trigger 21 is also positioned normal to the back portion 5 so that the user can apply a force on the trigger 21 that is parallel to the length of the locking bar 22.

In reference to FIG. 6B, the switch 24 is used to create an electrical break in the circuit between the vehicle's side-marker-light or tail-light system and the plurality of weatherproof LED strips 14. The inclined protrusion 23 is used to gradually press down on the switch 24 and create the electrical break as the locking bar 22 traverses into the placard slot 8. The inclined protrusion 23 is laterally positioned and perpendicularly connected to the locking bar 22 so that the inclined protrusion 23 can move back and forth with the locking bar 22 while the user is pressing the trigger 21. The switch 24 is mounted within the mechanism compartment 10 adjacent to the placard slot 8, which allows the inclined plane to gradually press down on the switch 24 as the locking bar 22 traverses into the placard slot 8. Consequently, the switch 24 should be positioned in between the inclined protrusion 23 and the mechanism compartment 10.

The plurality of weatherproof LED strips 14 is electrically powered by the vehicle's side-marker-light or tail-light system, which allows the plurality of weatherproof LED strips 14 to turn on/off when the vehicle's side-marker-light or tail-light system turns on/off. In addition, the plurality of weatherproof LED strips 14 blinks or flashes when the vehicle's side-marker-light or tail-light system blinks or flashes. The first wire 15 and the second wire 16 are used to redirect electrical power from the vehicle's side-marker-light or tail-light system. In the preferred embodiment of the present invention, the first wire 15 and the second wire 16 are four feet long, which is an adequate distance to position the present invention anywhere from the vehicle's side-marker-light or tail-light system. The first wire 15 and the second wire 16 each comprise a proximal end 17 and a distal end 18, which are positioned opposite to each other. The distal end 18 for both the first wire 15 and the second wire 16 is located outside of the placard frame 1 so that the distal end 18 for both the first wire 15 and the second wire 16 can splice into the vehicle's side-marker-light or tail-light system. The proximal end 17 for both the first wire 15 and the second wire 16 traverses into the placard slot 8 in order to complete the circuit between the vehicle's side-marker-light or tail-light system and the plurality of weatherproof LED strips 14. Thus, the proximal end 17 of the first wire 15 is electrically connected to the plurality of weatherproof LED strips 14. However, the proximal end 17 of the second wire 16 is electrically connected to the plurality of weatherproof LED strips 14 through the switch 24 so that the switch 24 can break the circuit between the vehicle's side-marker-light or tail-light system and the plurality of weatherproof LED strips 14.

In the preferred embodiment of the present invention, the front portion 2 and the back portion 5 of the placard frame 1 are held together with a plurality of recessed guide lines 12 and a plurality of rivets 13, which are illustrated in FIGS. 1, 2, and 3. The plurality of rivets 13 is used as the means of fastening the front portion 2 to the back portion 5 by traversing through both the front portion 2 and connecting to the back portion 5. The plurality of recessed guide lines 12 is used to dictate where on the placard frame 1 that the plurality of rivets 13 will traverse through the front portion 2 and connect to the back portion 5. Thus, the plurality of rivets 13 is aligned with the plurality of recessed guide lines 12. The plurality of recessed guide lines 12 is embedded into the front portion 2 so that the manufacturer can more easily press the plurality of rivets 13 through the front portion 2 and then guide the plurality of rivets 13 to connect with the back portion 5. The plurality of recessed guide lines 12 is also located around the plurality of weatherproof LED strips 14, which prevents the plurality of rivets 13 from intersecting any of the other components for the placard frame 1.

Although the invention has been explained in relation to its preferred embodiment, it is to be understood that many other possible modifications and variations can be made without departing from the spirit and scope of the invention as hereinafter claimed.

What is claimed is:

1. A glowing frame for a hazardous material placard comprises:

a placard frame;

a drain hole;

a plurality of weatherproof light emitting diode (LED) strips;

a first wire;

a second wire;

a disconnection mechanism;

said placard frame comprises a front portion, a back portion, a housing cavity, a wing extension, a placard slot, a ramp, and a mechanism compartment;

said first wire and said second wire each comprise a proximal end and a distal end;

said disconnection mechanism comprises a switch, a guide body, a trigger, a locking bar, and an inclined protrusion;

said front portion comprises a placard window and a plurality of grids;

said guide body being mounted within said mechanism compartment;

said locking bar being positioned perpendicular to said placard slot;

said locking bar traversing through said mechanism compartment and being slidably engaged to said guide body;

said trigger being positioned normal to said back portion;

said trigger traversing through said mechanism compartment and being connected perpendicular to said locking bar;

said inclined protrusion being laterally positioned to said locking bar;

said inclined protrusion being connected perpendicular to said locking bar;

said switch being mounted within said mechanism compartment adjacent to said placard slot; and said switch being positioned in between said inclined protrusion and said mechanism compartment.

2. The glowing frame for a hazardous material placard as claimed in claim 1 comprises:

said front portion being concentrically positioned onto said back portion;

said placard window centrally traversing through said front portion;

said plurality of grids being positioned across said placard window;

said housing cavity being positioned in between said plurality of grids and said back portion;

said housing cavity being laterally delineated by said placard window; and said drain hole traversing out of said housing cavity and through both said front portion and said back portion.

3. The glowing frame for a hazardous material placard as claimed in claim 1 comprises:

said wing extension being connected adjacent to both said front portion and said back portion;

said mechanism compartment being centrally integrated into said wing extension;

said placard slot traversing through said front portion and into housing cavity;

said placard slot being positioned adjacent to said mechanism compartment; and said ramp being positioned along said placard slot and being connected to said back portion.

4. The glowing frame for a hazardous material placard as claimed in claim 1 comprises:

said plurality of weatherproof LED strips being conformingly positioned around said placard window;

said plurality of weatherproof LED strips being located around said placard slot; and said plurality of weatherproof LED strips being housed in between said front portion and said back portion.

5. The glowing frame for a hazardous material placard as claimed in claim 1 comprises:

said proximal end and said distal end being positioned opposite to each other;

said distal end for both said first wire and said second wire being located outside of said placard frame;

said proximal end for both said first wire and said second wire traversing into said placard frame;

said proximal end of said first wire being electrically connected to said plurality of LED strips; and said proximal end of said second wire being electrically connected to said plurality of LED strips through said switch.

6. The glowing frame for a hazardous material placard as claimed in claim 1 comprises:

a plurality of recessed guide lines;

a plurality of rivets;

said plurality of recessed guide lines being embedded into said front portion;

said plurality of recessed guide lines being located around said plurality of weatherproof LED strips;

said plurality of rivets being aligned with said plurality of recessed guide lines; and said plurality of rivets traversing through said front portion and connecting to said back portion.

7. A glowing frame for a hazardous material placard comprises:

a placard frame;

a drain hole;

a plurality of weatherproof light emitting diode (LED) strips;
a first wire;
a second wire;
a disconnection mechanism;
said placard frame comprises a front portion, a back portion, a housing cavity, a wing extension, a placard slot, a ramp, and a mechanism compartment;
said first wire and said second wire each comprise a proximal end and a distal end;
said disconnection mechanism comprises a switch, a guide body, a trigger, a locking bar, and an inclined protrusion;
said front portion comprises a placard window and a plurality of grids;
said front portion being concentrically positioned onto said back portion;
said placard window centrally traversing through said front portion;
said plurality of grids being positioned across said placard window;
said housing cavity being positioned in between said plurality of grids and said back portion;
said housing cavity being laterally delineated by said placard window;
said drain hole traversing out of said housing cavity and through both said front portion and said back portion;
said plurality of weatherproof LED strips being conformingly positioned around said placard window;
said plurality of weatherproof LED strips being located around said placard slot;
said plurality of weatherproof LED strips being housed in between said front portion and said back portion;
said wing extension being connected adjacent to both said front portion and said back portion;
said mechanism compartment being centrally integrated into said wing extension;
said placard slot traversing through said front portion and into housing cavity;
said placard slot being positioned adjacent to said mechanism compartment;
said ramp being positioned along said placard slot and being connected to said back portion;
said guide body being mounted within said mechanism compartment;
said locking bar being positioned perpendicular to said placard slot;
said locking bar traversing through said mechanism compartment and being slidably engaged to said guide body;
said trigger being positioned normal to said back portion;
said trigger traversing through said mechanism compartment and being connected perpendicular to said locking bar;
said inclined protrusion being laterally positioned to said locking bar;
said inclined protrusion being connected perpendicular to said locking bar;
said switch being mounted within said mechanism compartment adjacent to said placard slot; and
said switch being positioned in between said inclined protrusion and said mechanism compartment.

8. The glowing frame for a hazardous material placard as claimed in claim 7 comprises:
said proximal end and said distal end being positioned opposite to each other;
said distal end for both said first wire and said second wire being located outside of said placard frame;
said proximal end for both said first wire and said second wire traversing into said placard frame;
said proximal end of said first wire being electrically connected to said plurality of LED strips; and
said proximal end of said second wire being electrically connected to said plurality of LED strips through said switch.

9. The glowing frame for a hazardous material placard as claimed in claim 7 comprises:
a plurality of recessed guide lines;
a plurality of rivets;
said plurality of recessed guide lines being embedded into said front portion;
said plurality of recessed guide lines being located around said plurality of weatherproof LED strips;
said plurality of rivets being aligned with said plurality of recessed guide lines; and
said plurality of rivets traversing through said front portion and connecting to said back portion.

10. A glowing frame for a hazardous material placard comprises:
a placard frame;
a drain hole;
a plurality of weatherproof light emitting diode (LED) strips;
a first wire;
a second wire;
a disconnection mechanism;
said placard frame comprises a front portion, a back portion, a housing cavity, a wing extension, a placard slot, a ramp, and a mechanism compartment;
said first wire and said second wire each comprise a proximal end and a distal end;
said disconnection mechanism comprises a guide body, a trigger, a locking bar, and an inclined protrusion;
said front portion comprises a placard window and a plurality of grids;
said wing extension being connected adjacent to both said front portion and said back portion;
said mechanism compartment being centrally integrated into said wing extension;
said placard slot traversing through said front portion and into housing cavity;
said placard slot being positioned adjacent to said mechanism compartment;
said ramp being positioned along said placard slot and being connected to said back portion;
said guide body being mounted within said mechanism compartment;
said locking bar being positioned perpendicular to said placard slot;
said locking bar traversing through said mechanism compartment and being slidably engaged to said guide body;
said trigger being positioned normal to said back portion;
said trigger traversing through said mechanism compartment and being connected perpendicular to said locking bar;
said inclined protrusion being laterally positioned to said locking bar;
said inclined protrusion being connected perpendicular to said locking bar;
said switch being mounted within said mechanism compartment adjacent to said placard slot; and
said switch being positioned in between said inclined protrusion and said mechanism compartment.

11. The glowing frame for a hazardous material placard as claimed in claim 10 comprises:

said front portion being concentrically positioned onto said back portion;

said placard window centrally traversing through said front portion;

said plurality of grids being positioned across said placard window;

said housing cavity being positioned in between said plurality of grids and said back portion;

said housing cavity being laterally delineated by said placard window;

said drain hole traversing out of said housing cavity and through both said front portion and said back portion;

a plurality of recessed guide lines;

a plurality of rivets;

said plurality of recessed guide lines being embedded into said front portion;

said plurality of recessed guide lines being located around said plurality of weatherproof LED strips;

said plurality of rivets being aligned with said plurality of recessed guide lines; and said plurality of rivets traversing through said front portion and connecting to said back portion.

12. The glowing frame for a hazardous material placard as claimed in claim 10 comprises:

said plurality of weatherproof LED strips being conformingly positioned around said placard window;

said plurality of weatherproof LED strips being located around said placard slot;

said plurality of weatherproof LED strips being housed in between said front portion and said back portion;

said proximal end and said distal end being positioned opposite to each other;

said distal end for both said first wire and said second wire being located outside of said placard frame;

said proximal end for both said first wire and said second wire traversing into said placard frame;

said proximal end of said first wire being electrically connected to said plurality of LED strips; and said proximal end of said second wire being electrically connected to said plurality of LED strips through said switch.

* * * * *